United States Patent [19]

Logsdon

[11] Patent Number: 4,564,249

[45] Date of Patent: Jan. 14, 1986

[54] MINIATURE WASHING MACHINE BOX

[76] Inventor: Duane D. Logsdon, P.O. Box 186, Stanton, Calif. 90680

[21] Appl. No.: 568,892

[22] Filed: Jan. 6, 1984

[51] Int. Cl.[4] ..... F16L 5/00

[52] U.S. Cl. ..... 312/229; 137/360; 312/242

[58] Field of Search ..... 312/229, 242, 245; 220/266, 276; 137/360, 361; 248/27.1, 201, 221.3, 222.2

[56] References Cited

U.S. PATENT DOCUMENTS

| | | | |
|---|---|---|---|
| 685,906 | 11/1901 | Anderson | 220/269 |
| 3,151,765 | 10/1964 | Griese | 220/269 |
| 3,567,061 | 3/1971 | Song | 220/266 |
| 3,799,387 | 3/1974 | Zenz | 248/27.1 |
| 3,834,781 | 9/1974 | Logsdon | 312/229 |
| 4,007,852 | 2/1977 | Gernhardt | 220/266 |
| 4,106,736 | 8/1978 | Becker et al. | 248/222.2 |
| 4,149,651 | 4/1979 | Ignell | 220/266 |
| 4,158,471 | 6/1979 | Logsdon | 312/229 |
| 4,231,486 | 11/1980 | Bock | 220/266 |
| 4,410,004 | 10/1983 | Kifer et al. | 137/366 |

*Primary Examiner*—William E. Lyddane
*Assistant Examiner*—Joseph Falk
*Attorney, Agent, or Firm*—K. H. Boswell; Edward D. O'Brian

[57] ABSTRACT

A washing machine outlet box of the type capable of fitting within a wall and attaching to wall studs within this wall is improved by incorporating during the manufacture of said washing machine outlet box a disc as an integral part of the bottom wall, with the disc located over the future drain opening. The disc is attached to the bottom wall by a breakable or severable ring. After installation of the washing machine outlet box to an appropriate drain pipe, the disc serves as a plug for pressure testing of the drain pipe and further serves as a dam to prevent introduction of foreign material into the drain pipe during construction stages of the wall and the like. Upon completion of pressure testing and after completion of construction, a tab attaching to the disc is lifted upwardly so as to sever the ring attaching the disc to the wall to free the disc to form the drain opening in the bottom wall of the washing machine outlet box.

1 Claim, 8 Drawing Figures

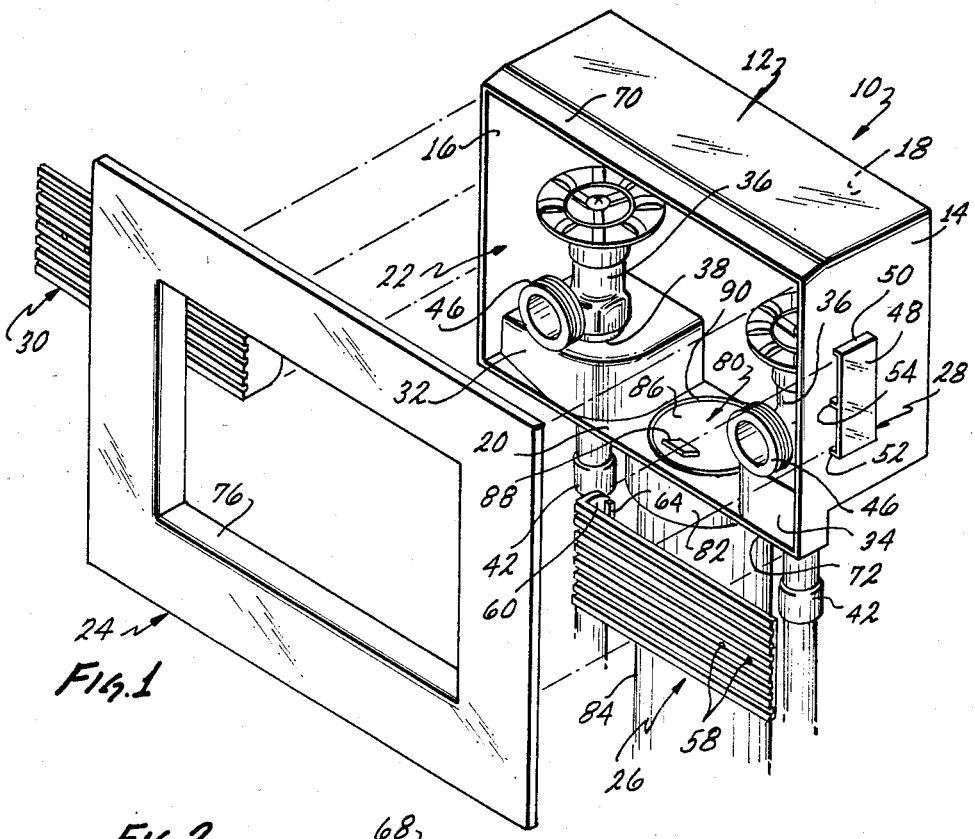
Fig. 1
Fig. 2
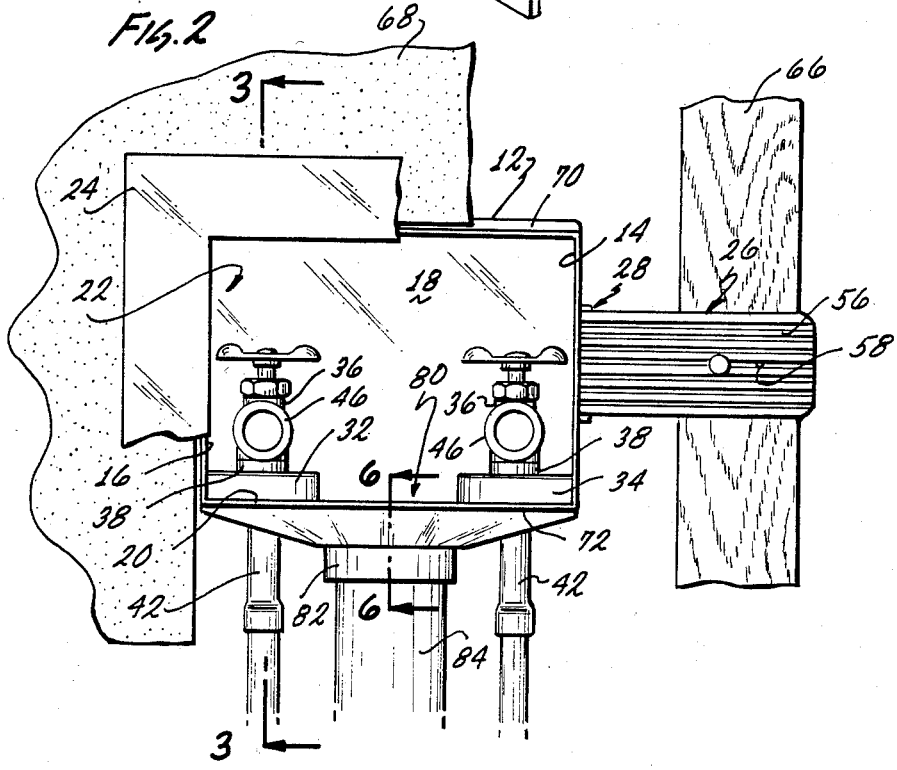

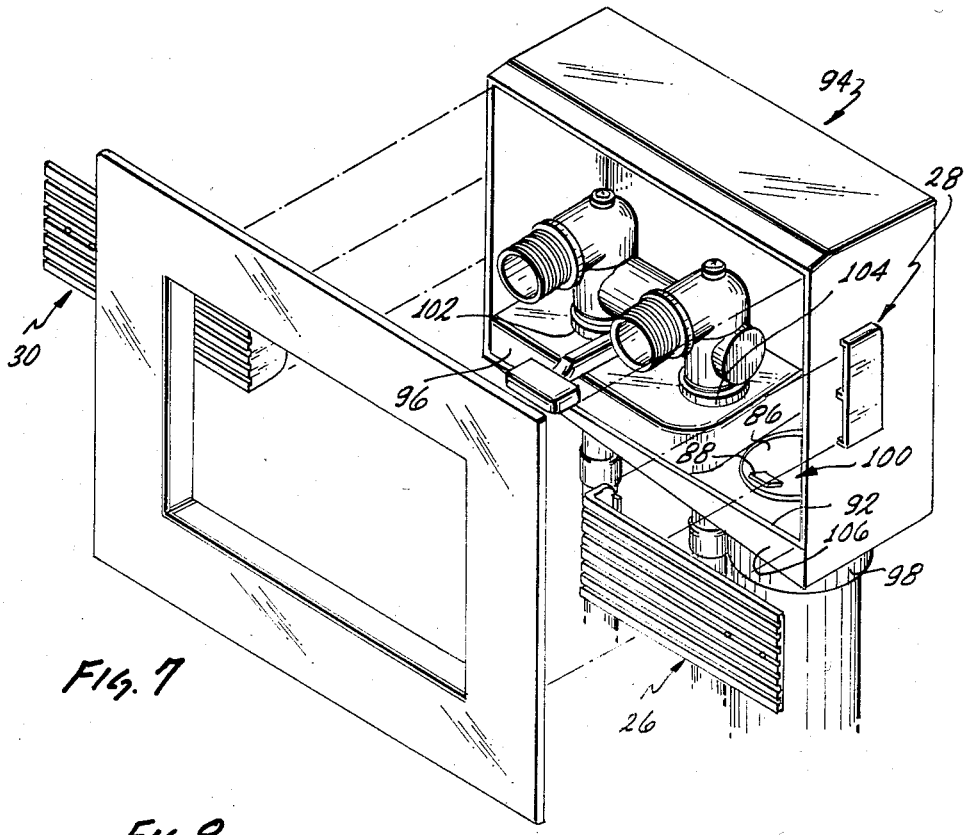
Fig. 7
Fig. 8
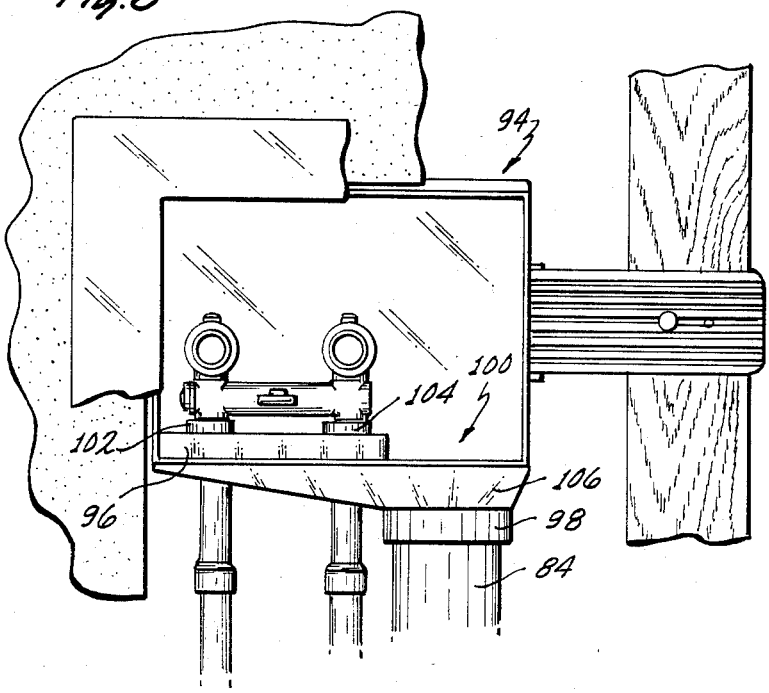

MINIATURE WASHING MACHINE BOX

BACKGROUND OF THE INVENTION

This invention is directed to a washing machine outlet box of the type fitting in the wall and suitable to accommodate both a hot and cold water valve as well as a drain pipe.

In my patents, U.S. Pat. Nos. 4,158,471 and 3,834,781, I describe two washing machine outlet boxes which are utilized in conjunction with the hot and cold water outlet valves for a washing machine, as well as the drain pipe of the same. The washing machine outlet valves illustrated in these two patents have certain utilitarian features and functions which make them highly desirable for use in conjunction with the plumbing attachments for washing machines. However, because of certain construction techniques, certan code requirements and certain new plumbing appliances which are now available, the prior known washing machine outlet boxes are deficient with regard to one or another of these items.

It has become desirable to reduce the size of washing machine outlet boxes such that they are of a small a size as possible, yet still can accommodate both a hot and cold water valve and receive the drain hose of a washing machine. With miniaturization of the washing machine outlet box, consideration must be given to the increased distance between the outlet box and the distance between the side of the outlet box and a standard wall studs which are placed at sixteen inches on center. The connecting tabs, or brackets for a smaller washing machine outlet box must, of necessity, span a greater space before these brackets can be connected to an appropriate wall stud. The prior known method of attaching the connecting brackets is not directly applicable to a miniaturized washing machine outlet box because of the instability of the box with respect to the wall because of flexure of the brackets at the point of attachment to the outlet box.

The washing machine outlet boxes are mounted in new construction prior to the application of dry wall. During the application of the dry wall, and during subsequent plumbing operations wherein valves and the like are attached to pipes within the washing machine outlet box, because the bottom of the prior known washing machine outlet boxes were designed to collect all water leakage the bottom also collected construction debris and channeled the same down onto the drain pipes leading from the washing machine outlet box drain opening. This debris can accumulate in the traps attached to these drain pipes, and when the consumer starts utilizing a washing machine attached to the washing machine outlet box, clogs and the like have resulted from the construction debris lodged in the traps. Since the traps are now dry walled into a wall, and since the traps are often located within a cement slab, the unclogging of this debris is both an irritant and an unnecessary expense.

Further, many plumbing codes require a pressurization check of all of the sewer plumbing as a part of an inspection procedure after the rough plumbing has been completed. This requires the insertion of a test plug into the drain outlet of the washing machine outlet box. The insertion of such a plug into the washing machine outlet box leads to an unnecessary material and labor expense which is ultimately passed on to the consuming public.

In prior known washing machine outlet boxes, the placement of the hot and cold water valves within the physical confines of the interior of the washing machine outlet box was at the whim and will of the plumber installing the same. If due care was not exercised by the plumber, it was possible to position the valve very near the bottom surface of the washing machine outlet box, such that it was then difficult to further attach the hoses leading from these valves directly to the washing machines. For convenience of the consumer, the valves should be placed in positions which allow hand connection of the hoses and the like to the valves without having to resort to the use of tools to attach a hose to a valve which was placed too close to the bottom of the washing machine outlet box.

Aside from the above problems, a combined hot and cold water valve is now available wherein a single lever can be utilized to control simultaneously both the hot and cold water valves. This lever is a throw lever and does not require the hand turning of valve knobs and the like. It is recommended by most washing machine manufacturers that the valves to which the inlet hoses are attached be closed inbetween uses of the washing machine in order to prevent the control valves in the washing machine itself from being exposed to the effects of continuous water pressure. The single lever valve allows for convenient turning off and on of the water lines leading to the washing machine without having to rotate a valve knob, which is both time consuming and irritating to the user of the appliance to such an extent that normally the appliance user would neglect to do the same. Unfortunately, the prior known washing machine outlet boxes do not accept the single lever outlet valve because of the placement of the drain of the washing machine outlet valves in the very center, with openings for the hot and cold water lines then placed to the left and right of the drain opening respectively. This essentially precludes the use of a single lever valve in combination with the washing machine outlet box.

BRIEF DESCRIPTION OF THE INVENTION

In view of the above, it is apparent that there exists a need for new and improved washing machine outlet boxes. It is therefore a broad object of this invention to provide such new and improved washing machine outlet boxes. Further, it is an additional object of this invention to provide a washing machine outlet box which incorporates a built in test cap, such that the sewer lines of the structure wherein the washing machine outlet box is mounted can be appropriately pressure tested without the use of auxiliary test caps and the like. Further it is an object of this invention, in one embodiment of the invention, to provide a washing machine outlet box which can be utilized with a single lever hot and cold water inlet valve. Additionally, it is an object of this invention to provide an embodiment of the invention which provides for miniaturization of the washing machine outlet box yet still allows for mounting of the box between common sixteen inch on center wall studs.

These and other objects, as will become evident from the remainder of this specification, are achieved in a washing machine outlet box capable of fitting within a wall and attaching to support members located in said wall, said washing machine outlet box being an integrally formed water impervious plastic cabinet having a top, a back, sides, a front opening and a with said bottom including in a bottom drain opening, the improvement which comprises: said bottom drain opening including a pipe section integrally formed on the under side of said cabinet and extending downwardly from said bottom of said cabinet, said pipe section sized and shaped so as to be mated to a drain pipe, said drain opening further including a circular body of a first thickness integrally formed over said pipe section and joined to said pipe section by a ring extending around said circular body and integrally connecting said circular body to the remainder of said bottom of said cabinet and wherein said ring is of a second thickness sufficiently less than said first thickness; said drain opening further including an upwardly extending gripping means integrally formed on the top of said circular body, said tab sized and shaped so as to be be grippable by a gripping object so as to allow removal of said circular body by gripping of said gripping means and forcing said circular body upwardly to sever said ring by upward pressure on said tab.

Further, the objects are achieved in incorporating a front edge on both the top and bottom of the cabinet of the washing machine outlet box such that a face plate having a flange located thereon can be conveniently slid into the front opening of the cabinet with frictional engagement between the front edges of the top and bottom with the face plate so as to mount the face plate to the cabinet.

Additionally, in one embodiment of the invention a singly raised platform extending from one of the sides of the cabinet over the center toward the other side with the drain then located next to the other side of the cabinet can be utilized or in a further embodiment of the invention dual platforms located on the left and right side of the cabinet with a central drain can be utilized with either of these platform arrangements having a total of two bosses located thereon which extend upwardly from the top of the platform or platforms a distance so as to accept a pipe nipple through the box to allow for threading of a water valve on top of the nipple in a position wherein the water valve is sufficiently upwardly displaced from the bottom of the washing machine outlet box so as to provide for convenient attachment and detachment of hoses leading from the water valve to the washing machine.

Further, by incorporating a central web in an attaching sleeve on either side of the cabinet of the washing machine outlet box, with a bracket having a slot so as to fit around this central web, increased stability of the mounting of the washing machine outlet box is achieved allowing for miniaturization of the box itself and elongation of the attaching brackets without compromising the fixed placement of the washing machine outlet box to appropriate wall studs.

BRIEF DESCRIPTION OF THE DRAWINGS

This invention will be better understood when taken in conjunction with the drawings wherein:

FIG. 1 is an exploded isometric view of the improved washing machine outlet box of this invention including a first and second water valve located therein which, while not forming a portion of the invention, facilitates understanding of the same;

FIG. 2 is a front elevational view in partial section of the placement of the washing machine outlet box of FIG. 1 within a typical wall structure;

FIG. 7 is an isometric view similar to certain portions of FIG. 1 showing an alternate embodiment of the invention; and FIG. 8 is a front elevational view of the embodiment seen in FIG. 7.

Figure 3:
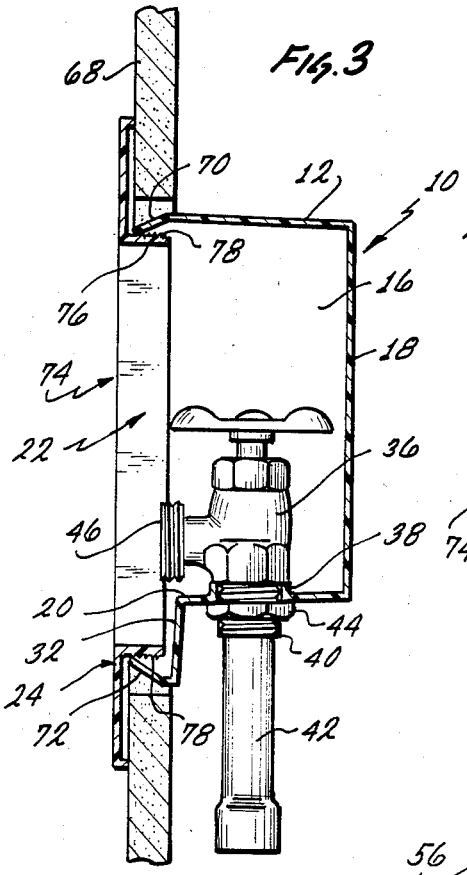
FIG. 3 is a side elevational view in section about the line 3—3 of FIG. 2.

The invention illustrated in the drawings and described in this specification utilizes certain principles and/or concepts as are set forth in the claims appended to this specification. Those skilled in the plumbing arts will realize that these principles and/or concepts are capable of being utilized with a variety of embodiments which may differ from the exact embodiments utilized for illustrative purposes herein. For this reason, this invention is not to be construed as being only limited to the illustrative embodiments but is only to be construed as being limited by the claims.

DETAILED DESCRIPTION OF THE INVENTION

Figure 4:
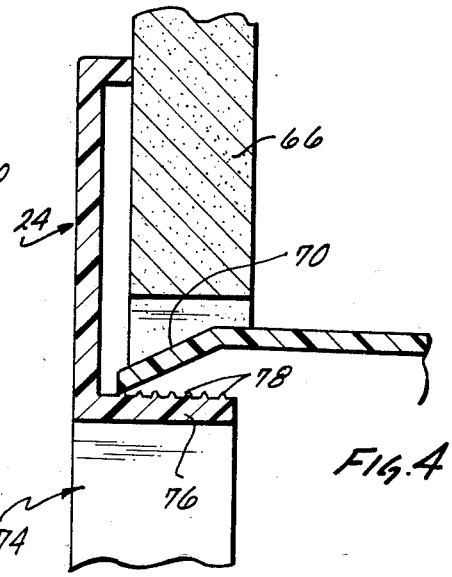
FIG. 4 is a fragmentary elevational view in section of a portion of FIG. 3.
Figure 5:
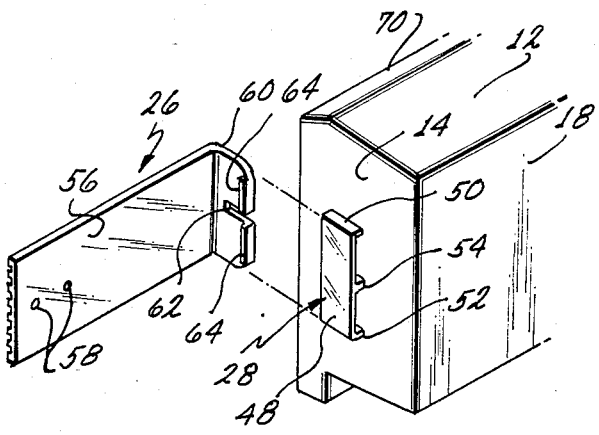
FIG. 5 is an exploded isometric view showing the back side of certain of the components as seen in FIG. 1.
Figure 6:
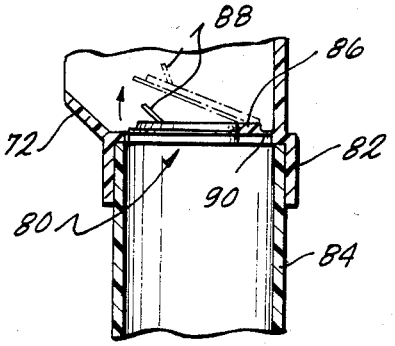
FIG. 6 is a side elevational view in section about the lines 6—6 of FIG. 2.

In the figures, FIGS. 1 and 2 show a first embodiment of the invention and FIGS. 7 and 8 show a second. The components of the invention as illustrated in FIGS. 4, 5 and 6 are common to both of these embodiments. The water valve shown in FIGS. 1, 2 and 3 does not form a portion of this invention and for the embodiment of FIGS. 7 and 8, a different water valve, also not forming a portion of this invention, would be utilized in conjunction with the washing machine outlet box illustrated therein. Both of the embodiments shown in FIGS. 1 and 2 and in FIGS. 7 and 8 have certain common features and because of these common features, identical numbers will be utilized in identifying the common features. Furthermore, in the interest of brevity of this specification, the common features will only be described with respect to one of the embodiments with it being understood that the description is equally applicable to the other embodiment.

In FIG. 1 there is shown a washing machine outlet box 10 which has a top 12, sides 14 and 16, back 18, a bottom 20 and a front opening 22. A face plate 24 attaches to the front opening 22 as hereinafter described and a bracket 26 attaches to a sleeve 28 with bracket 30 attaching to a similar sleeve not shown in the drawings, in a like manner.

Within the interior of the outlet box 10 there is a hot water platform 32 and a cold water platform 34. These accept hot and cold water valve collectively identified by the numeral 36. Each of the platforms 32 and 34 are raised above the bottom 20 of the outlet box 10. On the top surface of each of the platforms 32 and 34 is an identical upstanding boss 38 having a central opening. The opening through the bosses 38 accept a nipple 40 of a typical inlet pipe 42, whether it be hot or cold water, with the valve 36 then threading on to the nipple 40 and the totality of the valve and the pipe held fast to the outlet box 10 via a nut 44 which is threaded upwardly on the nipple 40 toward the valve 36. This unifies the valve 36 to the outlet box 10.

The valve 36, however, is displaced upwardly from both the bottom 20 of the outlet box 10 and the top of the platforms 32 or 34 in an amount sufficient to ensure threadability of a washing machine inlet hose to the nipple 46 formed on the valve 36. This allows for convenience of attachment and detachment of the washing machine inlet hose to the valve 36 without having to resort to pipe wrenches or the like. The nipple 46 of the valve 36, however, is still located within the confines of the outlet box 10 such that any leakage between the connection between the washing machine inlet hose and the nipple 46 is trapped within the outlet box 10 and is ultimately fed through a drain structure as hereinafter described.

As noted above, on both the right and left hand sides of the outlet box 10 are sleeves as illustrated by sleeve 28 on the right hand side of the outlet box 10 as seen in FIGS. 1, 7 and 5. The sleeve 28 includes an elongated plate 48 which is integrally formed via a top web 50 and bottom web 52 and a middle web 54 to one of the sides 14 or 16 of the outlet box 10. The totality of the outlet box including the sleeve 28 is preferredly formed of a plastic material using injection molding techniques or the like such that the sleeve 28 is part of the unified structure of the totality of the outlet box 10.

One of the brackets 26 or 30, which in fact are identical except for their placement on the right and left hand side of the outlet box 10, are then attached to one of the sleeves 28. As can be seen in FIGS. 1, 7 or 5, the bracket 26 includes an elongated first plate 56 having a series of holes collectively identified by the numeral 58 located therein which allows for convenient attachment of the bracket to a wall stud by a nail, screw or other similar attaching method. The bracket further includes a second plate 60 which is located at a right angle to the first plate 56 which includes an elongated slot 62 formed therein. On the outer edge of the second plate 60 is a flange 64 which is utilized to lock the bracket into the sleeve 28. The second plate 60 is inserted into the sleeve 28 between the upper and lower webs 50 and 52 with the slot 64 fitting around the middle web 54. The second plate 60 is sized with respect to the width of the sleeve 30 such that when the second plate 60 is inserted through the sleeve 28 an amount of the second plate 60 equal to the thickness of the flange 64 extends beyond the width of the sleeve 28 such that the flange 64 pops out of the back side (i.e. the side closest to the observer in FIG. 5) of the sleeve 28 to lock the bracket to the sleeve 28.

Because of the presence of the middle web 54 as a part of the sleeve 28, the middle of the sleeve 28 cannot flex outwardly from one or the other of the sides 14 or 16 of the outlet box 10 which would result in flexure of the outlet box 10 with respect to the brackets 26 and 30 which in turn would result in wiggling or movement of the outlet box 10 with respect to wall studs 66 to which it is mounted. Furthermore, the engagement of the slot 64 with the central web 54 prevents rotational movement of the outlet box 10 with respect to the brackets 26 and 30 to prevent either the top or the bottom of the outlet box 10 moving toward or away from the plane of the surface of the wall 68 in which the outlet box 10 is mounted. Thus, the presence of the middle web 54 and the slot 62 prevent both flexure of the sleeves 28 to limit one direction of movement of the outlet box 10 and rotation of the outlet box 10 to further limit rotation of the outlet box 10. This leads to a more secure mounting of the outlet box 10.

Additionally, because the middle web 54 prevents flexure of the sleeves 28 the longitudinal dimension of the first plate 56 can be increased, which allows miniaturization of the size of the outlet box 10 with respect to prior known outlet boxes without loss of strength or security of attachment of the same to the wall studs 66 and the wall 68 in which the outlet box 10 is mounted.

Referring now to FIG. 3, it can be seen that the front edge 70 of the top 12 projects downwardly as it projects outwardly. This is seen in greater detail in FIG. 4. The front edge 72 of the bottom wall 20 also projects inwardly as it projects outwardly.

The face plate 24 is formed as a rectangular frame having an opening 74 located in the middle therein. Surrounding the opening 74 is a continuous flange 76. The size of the flange 76 is such that it fits right within the front opening 22 in contact with both the front edges 70 and 72 of the top and bottom walls respectively and against the two side walls 14 and 16. The inside surface of the flange 76 wherein it contacts the front edges 70 and 72 contains a plurality of longitudinally extending ribs 78 which engage with the edges 70 and 72 in a ratchet like manner allowing for simple insertion of the face plate 24 onto the outlet box 10 to complete its installation without having to resort to screws and the like to attach the same. Aside from ease of installation, this is also more aesthetic appearing in that screw heads are not exposed as they are in prior known outlet boxes.

The front edge 72 of the bottom wall 20 slopes downwardly toward the drain opening 80 of the outlet box 10. This channels any water leakage within the outlet box 10 toward the drain opening 80 so as to appropriately dispose of this leakage without discoloration or destruction of the wall 66.

The drain opening 80 is formed by a short flange 82 which solvent welded to an appropriate drain pipe 84 during installation of the outlet box 10. As supplied from the manufacturer, the outlet box 10 as well as the further embodiment as hereinafter explained, includes a central disc 86 which is integrally formed with the bottom 20 during the manufacturing procedure. The disc 86 includes a tab 88 formed on its surface. There is a ring of material, identified by the numeral 90 in FIG. 6 which joins the disc 88 to the remainder of the bottom 20 as manufactured. The thickness of the ring 90 is sufficiently less than either the thickness of the disc 86 or the bottom 20. During installation, as noted above, the outlet box is installed to the drain pipe 84 by solvent welding the flange 82 to the drain pipe 84. At this point, the sewer piping can then be pressure tested as per certain code requirements in many localities. The disc 86 at this time, in conjunction with the ring 90 is effectively sealing the top of the drain pipe 84 such that the same can be pressure tested without having to attempt to plug the opening 80 with some other type of appliance, rubber ring or the like. This facilitates inspection and setup of the washing machine outlet box 10, eliminating the need of both an external appliance and the labor associated with attempting to place the same in the drain opening 80 in such a manner that the drain pipe 84 is sealed tightly to the degree necessary for the pressure testing.

The presence of the disc 86 within the drain opening 80 serves a second function in that prior to usage of the washing machine outlet box 10 it prevents the introduction of foreign matter into the drain pipe 84 and thus serves as a prophylactic measure with regard to preventing accumulation of any matter in the drain pipe 84 or in the trap connected thereto which may led to a stoppage or a blockage of the drain pipe 84.

Once the proper plumbing inspections are concluded and construction is complete, just prior to utilization of the outlet box 10, the gripping tab 88 is gripped with a pair of pliers or similar gripping appliance and moved upwardly to sever the disc 86 from the remainder of the bottom 20 by breakage of the material constituting the ring 90. Since the material constituting the ring 90 is much thinner than the disc 86, the disc 86 breaks cleanly, forming a nice circular opening within the bottom 20 to serve as the drain opening 80 leading to the drain pipe 84. The presence of the tab 88 also insures that the disc 86 will be lifted out of the washing machine outlet box 10 to insure that it does not become deposited into the drain pipe 84 as might occur if an impact type knock out plug of the type utilized for hot and cold water inlets in previously known washing machine outlet boxes was utilized.

Once the disc 86 has been removed from the bottom 20 of the outlet box 10, the opening 86 then comprises the lowest opening within the outlet box 10 to insure channeling of any water from a leaky valve 36 or the connection between the valve 36 and the washing machine hoses into the drain opening 80.

The embodiment of FIGS. 7 and 8 utilizes the same type of face plate 24 as was previously described, the same type of mounting brackets 26 and 30 in conjunction with sleeves 28 as previously described, as well as a disc 86 also as previously described. For the embodiment of FIGS. 7 and 8 however, the bottom wall 92 of the outlet box 94 described therein has a slightly different geometry than the bottom wall 26 of the outlet box 10. Further, in place of two platforms 32 and 34 as previously described, a single platform 96 is utilized. The bottom wall 92 includes a drain flange 98 which is located around a drain opening 100 which is exactly equivalent to the flange 64 and the opening 80 previously described except for location of the same. A disc 86 including a tab 88 is utilized in conjunction with the flange 98 to initially seal the drain opening 100 after it is connected to a drain pipe 80.

The platform 96 has a first boss 102 and a second boss 104 located thereon which serves the same function as the bosses 38 previously described. They are, however, located on the singular platform 96 in a spaced relationship so as to allow for the attachment of a single lever washing machine outlet valve such as that described in U.S. Pat. No. 3,234,958. In the same manner as described for the bosses 38, the bosses 102 and 104 appropriately place such a single lever outlet valve upwardly with respect to the top surface of the platform 96 and the bottom wall 92 of the outlet box 94 allowing for convenient attachment of appropriate washing machine inlet hoses to this valve.

The front edge 106 of the bottom wall 92 of the outlet box 94 is appropriately tapered in the same manner as was the front edge 72 of the previous embodiment allowing for convenient attachment of a face plate 24. Its geometry however, is slightly modified so as to accommodate the slope of the bottom wall 92 as is seen in FIGS. 7 and 8. And as with the prior embodiment, it serves to collect all water which is inappropriately discharged within the interior of the outlet box 94 and divert the same to the drain opening 100 for disposal into the drain pipe 84.

While the outlet box 94 is primarily designed for use with a single lever outlet valve, it of course can be used with two single outlet valve such as valves 36 in the same manner as the valve are utilized with the outlet box 10. The only difference here is that the single valve 36 would be located adjacent to one another and would not be separated by a drain opening.

I claim:

1. A washing machine outlet box capable of fitting within a wall and attaching to support members located in said wall, said washing machine outlet box being an integrally formed water impervious plastic cabinet having a top, a back, sides, a front opening and a bottom with said bottom including a bottom drain opening, the improvement which comprises:

said top of said cabinet having a front edge, said front edge of said top extending forwardly and downwardly over said front opening so as to form an acute angle to the plane of said front opening of said cabinet, the forwardmost portion of said bottom extending forwardly and upwardly over said front opening so as to form a front edge of said bottom, said front edge of said bottom sloping downwardly towards said drain opening and forming an acute angle to the plane of said front opening of said cabinet, said bottom including a vertically extending wall at the rear of said forwardmost portion which defines a channel with said forwardmost portion which slopes downwardly toward said drain opening, a face plate shaped as a frame whose outside periphery is of a greater dimension than the outside periphery of the front opening of said cabinet and including an opening located in said frame wherein the periphery of said opening is of a smaller dimension than the outside periphery of said front opening of said cabinet, said face plate including a flange located perpendicularly to said frame and extending around said opening in said frame, said flange sized and shaped so as to extend inwardly into said front opening of said cabinet, said face plate fitting against said cabinet with said flange fitting into said front opening so as to position portions of said flange against said front edges of said top and said bottom, said portions of said flange which fit against said front edges of said top and said bottom including a plurality of longitudinally oriented ridges capable of frictionally engaging said front edges of said top and said bottom.

* * * * *

UNITED STATES PATENT AND TRADEMARK OFFICE

CERTIFICATE OF CORRECTION

PATENT NO. : 4,564,249

DATED : January 14, 1986

INVENTOR(S) : DUANE D. LOGSDON

It is certified that error appears in the above-identified patent and that said Letters Patent is hereby corrected as shown below:

Column 2, line 67, delete the third "a".
Column 3, line 15, delete the second "be".
Column 5, line 38, "64" should be —62—.
Column 5, line 55, "64" should be —62—.
Column 6, line 32, "66" should be —68—.
Column 7, line 36, "64" should be —82—.
Column 7, line 40, "80" should be —84—.

Signed and Sealed this

*Tenth* Day of *June 1986*

[SEAL]

*Attest:*

DONALD J. QUIGG

*Attesting Officer*

*Commissioner of Patents and Trademarks*